US006361262B1

(12) United States Patent
Roodenburg

(10) Patent No.: US 6,361,262 B1
(45) Date of Patent: Mar. 26, 2002

(54) DRILLING VESSEL PROVIDED WITH AUXILIARY TOWER OR AUXILIARY MAST

(75) Inventor: Joop Roodenburg, Delft (NL)

(73) Assignee: Huisman Special Lifting Equipment B.V., Ad Schiedam (NL)

( * ) Notice: Subject to any disclaimer, the term of this patent is extended or adjusted under 35 U.S.C. 154(b) by 0 days.

(21) Appl. No.: 09/486,766

(22) PCT Filed: Sep. 2, 1998

(86) PCT No.: PCT/NL98/00499

§ 371 Date: Mar. 2, 2000

§ 102(e) Date: Mar. 2, 2000

(87) PCT Pub. No.: WO99/11901

PCT Pub. Date: Mar. 11, 1999

(30) Foreign Application Priority Data

Sep. 2, 1997 (NL) ..... 1006920

(51) Int. Cl.[7] ..... E21B 19/00

(52) U.S. Cl. ..... 414/22.51; 414/22.62; 414/22.68; 175/52; 175/85; 166/77.51

(58) Field of Search ..... 414/22.51, 22.52, 414/22.54, 22.55, 22.56, 22.62, 22.61, 22.68, 22.63; 403/384, 388, 396, 391; 175/52, 85; 166/77.51

(56) References Cited

U.S. PATENT DOCUMENTS 2,413,297 A * 12/1946 Deckert ..... 414/22.51
3,305,107 A * 2/1967 Deel ..... 214/2.5
3,308,970 A * 3/1967 Wilson et al. ..... 414/22.5
3,403,791 A * 10/1968 Marks et al. ..... 414/22.5
3,780,883 A * 12/1973 Brown ..... 214/2.5
4,208,158 A 6/1980 Davies et al.
4,440,536 A * 4/1984 Scaggs ..... 414/22
4,610,315 A * 9/1986 Koga et al. ..... 175/85

FOREIGN PATENT DOCUMENTS

GB 2 291 664 1/1996

OTHER PUBLICATIONS

"New Ultra–Deepwater Rig with Dual Rotaries Will Reduce Costs" by Cole et al, Oil and Gas Journal, vol. 95, No. 21, May 1997.

"Converted SSCV Could Cut Costs" World Oil vol. 216, No. 4, Apr. 1995.

* cited by examiner

*Primary Examiner*—Joseph A. Fischetti
(74) *Attorney, Agent, or Firm*—Sughrue Mion, PLLC

(57) ABSTRACT

The present invention relates to a drilling vessel with drilling tower or drilling mast for drilling in the earth's surface from said vessel, for example for oil or gas. The drilling vessel according to the present invention is characterized by an auxiliary tower or mast placed next to the drilling tower or drilling mast, and a clamp carriage which is fixed so that it is movable between a first position near the drilling tower or drilling mast and a second position near the auxiliary tower or auxiliary mast, said clamp carriage having at least one gripping clamp for clamping the drill string. The presence of an auxiliary tower or auxiliary mast next to the drilling tower or drilling mast means that a substantial time gain can be achieved during the construction and dismantling of the drilling string.

5 Claims, 4 Drawing Sheets

DRILLING VESSEL PROVIDED WITH AUXILIARY TOWER OR AUXILIARY MAST

BACKGROUND OF THE INVENTION

The present invention relates to a drilling vessel with a drilling tower or a drilling mast for drilling in the earth's surface from the vessel, for example, for oil or gas.

In the prior art, it is known to drill in the earth's surface from a drilling vessel, for example, for oil or gas. The drilling is generally carried out by means of a bit mounted on the drilling string. Such a drilling string is constructed on the drilling vessel from separate drilling string elements. Adding drilling string components at the top side means that the drilling string can extend farther and farther at the bottom side of the drilling vessel in the direction of the seabed. Despite the fact that the drilling string can move freely through the water, feeding the drilling string to the seabed takes a relatively long time. Furthermore, the greater the depth to which drilling must be carried out, the more time is needed to construct the drilling string and to move the drilling string in the direction of the seabed.

If the bit fixed to the end of the drilling string becomes blunt during the drilling, the drilling string in its entirety must be raised to the drilling vessel. That means that the drilling string has to be dismantled into drilling string elements during the raising operation. This operation generally also takes a long time.

In view of the enormous investment which is necessary for the construction of a drilling vessel, the pressure becomes ever greater to increase the efficiency of these drilling vessels. The lengthy construction and subsequent dismantling of the drilling string is a major obstacle to improvement of the efficiency of such vessels.

SUMMARY OF THE INVENTION

It is an object of the present invention to provide a device by means of which considerable time can be saved during the construction and dismantling of the drilling string.

That object is achieved by an auxiliary tower or auxiliary mast placed next to the drilling tower or drilling mast, and a clamp carriage which is fixed so that it is movable between a first position near the drilling tower or drilling mast and a second position near the auxiliary tower or auxiliary mast, the clamp carriage having at least one gripping clamp for clamping the drill string.

It is advantageous here for the clamp carriage to comprise a clamp block with at least two gripping clamps, and for the clamp block to be fixed rotatably to the clamp carriage.

It is preferable to use masts instead of towers, because in this way the pipes can be transferred from a central pipe storage point, using a single facility, to the drilling mast and the auxiliary mast (and vice versa).

The presence of the auxiliary mast on the drilling vessel makes it possible to prepare a second drilling string while the first drilling string is being constructed, or when drilling is being carried out with the first drilling string, or when the first drilling string is being raised. There is no need to wait with the construction of the second drilling string until the moment when the first drilling string has been raised in its entirety to the drilling vessel. With the clamp carriage it is possible, when the bottom side (the bit) of the first drilling string has been raised from the drill hole, to grip the first drilling string with the clamp carriage, in which the second drilling string constructed in the meantime is also clamped. The second drilling string is then placed above the drill hole by a rotating movement. The second first drilling string can then be taken below the auxiliary mast by the clamp carriage, in order to raise the string and dismantle it further.

The great advantage of this is that a minimum amount of time is lost in raising the first drilling string. The first drilling string in fact only has to be raised over the length of the drilled hole, and as soon as the drill hole is clear the second drilling string can be placed in the drill hole. The first drilling string can be dismantled while drilling is already being carried out with the second drilling string. That means that with the drilling vessel according to the present invention relatively little time is lost in constructing drilling strings and dismantling them again.

The advantages described above also apply when constructing a casing or a riser from the drilling vessel. Just as in the case of the drilling string, the casing (lining of the top part of the drill hole) and the riser (sheath of the drilling string from the seabed to the drilling vessel) is constructed from separate elements situated on the vessel. During the construction and possible dismantling of the casings and/or risers, the presence of the auxiliary tower or auxiliary mast can produce a substantial time gain, just as in the case of the construction and dismantling of the drilling string.

The drilling vessel according to the present invention is further improved if the auxiliary tower or auxiliary mast is connected by means of a brace to the drilling tower or drilling mast.

The towers or the masts are subject to acceleration forces. That means that the towers or the masts have to be made relatively heavy, in order to be able to absorb such acceleration forces. If a physical connection is now made between the drilling tower or drilling mast and the auxiliary tower or auxiliary mast, a much more rigid construction is obtained, in which construction the towers or masts themselves can be made relatively light.

The drilling vessel according to the present invention is also improved if the vessel comprises means for supplying drilling string elements to and discharging them from the drilling mast, the supply and discharge means for the drilling string components being placed in such a way that drilling string components can be supplied with them from a central storage facility both for the drilling mast and for the auxiliary mast.

The great advantage of this is that instruments needed for use of the drilling mast, such as a gripping arm for passing over the drilling string components, can be used both for the drilling mast and for the auxiliary mast. That means that the use of the auxiliary mast does not require any additional investment in these instruments. The additional investment required for construction of the auxiliary mast consequently remains limited.

It is also advantageous for the masts to be attached to the drilling vessel by means of hinges.

If the drilling vessel is also being used for laying pipelines, as soon as the drill hole is clear it is advantageous for the angle between the longitudinal axis of the masts or the towers to be adjustable relative to the horizontal. The lines (for example rigid steel lines or flexible lines) are then sunk with the aid of the drilling mast and/or drilling mast and auxiliary mast. If the drilling vessel reaches a depth at which the lines to be laid can no longer leave the drilling vessel vertically at the bottom side, the drilling mast can be set in a slanting position, in order to be able to continue the sinking of the lines. A further advantage of the "hinged" attachment of the mast(s) here is that the mast can be dismantled in a simple manner and transferred to another vessel.

It is advantageous for the drilling mast and the auxiliary mast to be connected to the vessel by means of cylinders.

The advantage of this is that the rotation of the drilling mast and the auxiliary mast is relatively simple to set.

It is also advantageous for the drilling mast to comprise attachment means for attaching a tensioner.

That means that, for example, when flexibles are being laid a tensioner can be set on the drilling mast, in order to improve the laying of the lines.

BRIEF DESCRIPTION OF THE DRAWINGS

The present invention will be described with reference to the appended drawings, in which.

DETAIL DESCRIPTION OF THE PREFERRED EMBODIMENTS

Figure 1:
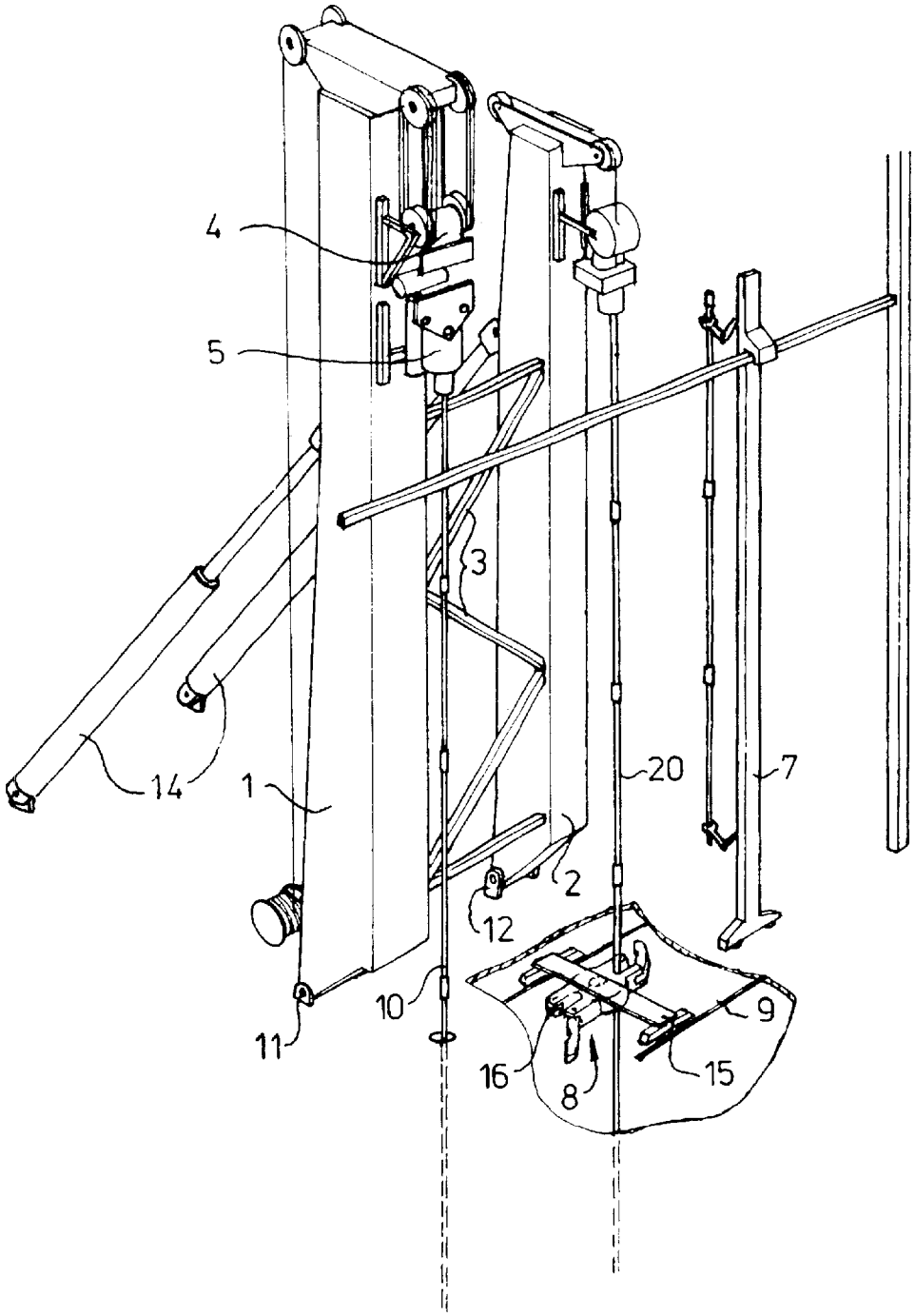
FIG. 1 is a view of a drilling mast with an auxiliary mast connected thereto.

FIG. 1 shows a view of a drilling mast 1 and an auxiliary mast 2 connected thereto. The masts are interconnected by means of a brace 3. The drilling mast 1 is provided on the top side with means which are necessary for maneuvering the drilling string during the drilling. The drawing shows, inter alia, the main frame 4 and the travelling block 5. In FIG. 1, the top part of the first drilling string 10 is shown on the drilling mast 1. The drilling string 10 is constructed on the drilling mast by, for example, gradually adding drilling string components to the drilling string 10. While the first drilling string 10 is being constructed, or while drilling is being carried out with the first drilling string 10, or while the first drilling string 10 is being raised and being dismantled, a second drilling string 20 is constructed on the auxiliary mast 2. For the construction of said second drilling string 20, the same supply means 7 for drilling string components is used as for the construction first drilling string 10. That means that the use of the auxiliary mast requires no additional investment in supply means for drilling string components. Since the drilling string 20 need only be constructed (or dismantled) with the aid of the auxiliary mast 2, and drilling does not have to be carried out with the aid of the auxiliary mast 2, the auxiliary mast 2 is not equipped with means which are necessary for drilling. The auxiliary mast 2 therefore does not require, for example, a drilling string compensator. This means that the auxiliary mast 2 can be of a relatively simple, and thus cheap, design. On the other hand, it is possible for drilling to be carried with the auxiliary mast.

FIG. 1 also shows the clamp carriage 8, which is movable from a position near the drilling mast to a position near the auxiliary mast 2. The clamp carriage 8 comprises a top part 15, which is movable in a guide 9. The clamp carriage 8 also comprises a clamp block 16, which is fixed rotatably on the top part 15 and is provided with two gripping clamps, which are suitable for clamping a drilling string therein. The operation of the clamp carriage will be explained further in FIGS. 2 and 3.

It can also be seen in FIG. 1 that the drilling mast 1 and the auxiliary mast 2 in the hinge points 11 and 12 are hinged connected to the drilling vessel (not shown). The vertical position of the masts 1, 2 can be maneuvered relative to the drilling vessel by means of the cylinders 14. The function of these cylinders will be explained further in FIG. 4.

Figure 2:
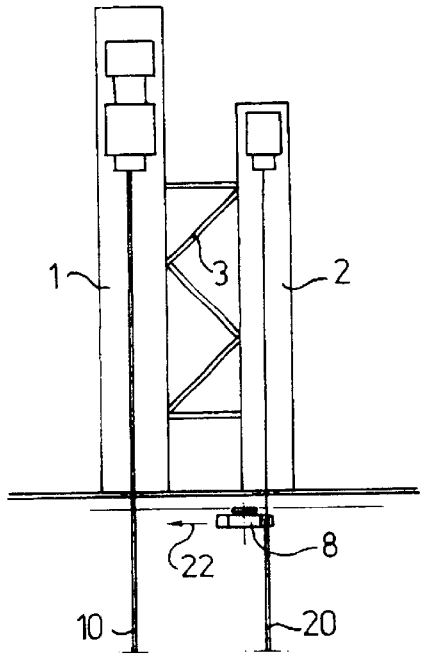
FIG. 2 shows a diagrammatic view of a drilling mast and an auxiliary mast in which the clamp carriage is situated below the auxiliary mast.

FIG. 2 shows diagrammatically the drilling mast 1 and the auxiliary mast 2 with the brace 3 between them. When the drilling string 10 on the drilling mast 1 has to be replaced, the top side of the drilling string 20 is clamped in the clamp carriage 8. The clamp carriage 8 then moves in the direction of the arrow 22 to the first drilling string 10, so that this drilling string 10 can also be clamped.

Figure 3:
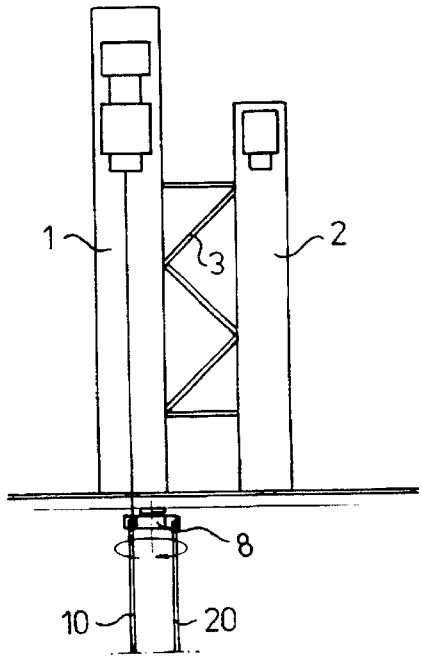
FIG. 3 is a diagrammatic view of a drilling mast and an auxiliary mast in which the clamp carriage is situated below the drilling mast.

FIG. 3 shows the situation in which the clamp carriage 8 has clamped both the first drilling string 10 and the second drilling string 20. As soon as the clamp carriage has clamped both drilling strings, the clamp block 16 of the clamp carriage 8 is rotated, so that the positions of the first and the second drilling string are reversed. It is then possible to drill with the second drilling string 20, which has taken over the position of the first drilling string 10, while the first drilling string 10 is moved by means of the clamp carriage 8 in the direction of the auxiliary mast 2. The auxiliary mast 2 can then be used for raising and dismantling the drilling string 10.

Figure 4:
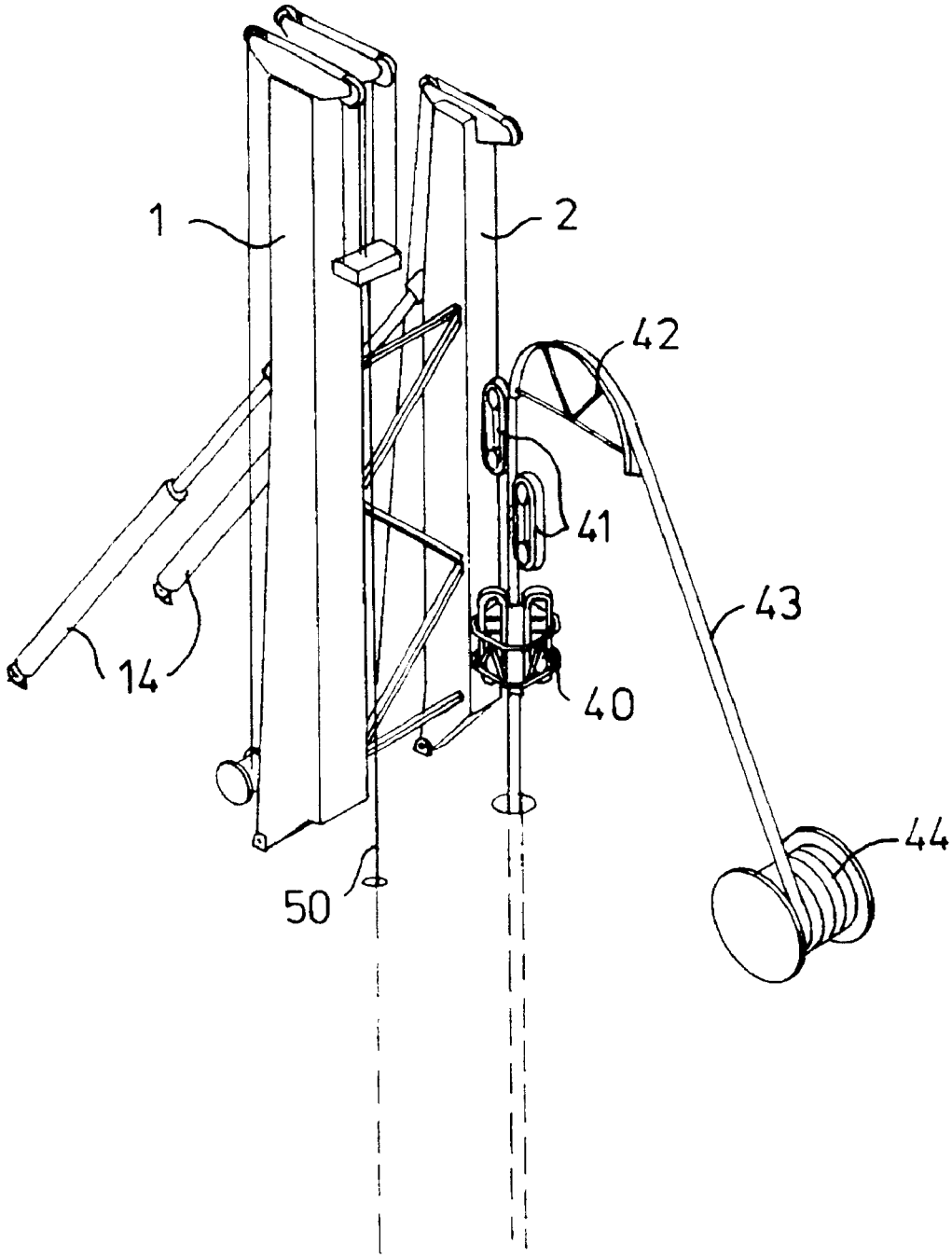
FIG. 4 is a view of a drilling mast and the auxiliary mast at the moment when the masts are being used for laying lines.

The use of an auxiliary mast 2 on a drilling vessel next to a drilling mast 1 has further advantages for the laying of lines on the seabed after the drilling work has been completed. Normally, a special laying vessel has to be used to sink lines to the vicinity of a drill hole made in the ground. An additional advantage of the use of a mast 1 or masts 1, 2 is that tensioners 40 are easy to mount on the masts. By fixing one or more tensioners 40 on the drilling mast 1 and/or on the auxiliary mast 2, the drilling vessel itself can be used for installing pipelines and flexibles. During the installation of the pipelines and the flexibles, the hoisting winch of the drilling gear can be used as an A & R winch (abandonment and recovery winch) if necessary, and the rotation table can be used here as a hang-off clamp, if necessary. The usability of the masts for laying pipelines is increased by the fact that the masts 1, 2 are rotatably fixed on the deck (see FIG. 5). By now making use of the auxiliary mast 2, the laying of lines can also be carried out with the aid of the drilling vessel. FIG. 4 shows a view of the drilling masts 1, 2, the auxiliary mast also having a tensioner 40 and straighteners 41 mounted thereon. In addition, a guide arch 42 is mounted on the auxiliary mast 2. FIG. 4 shows the instance where the auxiliary mast is being used for laying a steel pipe. Said pipe 43 is unreeled from a storage reel 44. By means of the guide arch 42, the pipe 43 is taken to the axis of the tensioner. Since the pipe 43 undergoes plastic deformation in this process, a straightener 41 is fitted, in order to make the pipe 43 straight. The pipe 43 is straightened out further by means of the straighteners 41. The tensioner 40 is used to prevent the pipe 43 from leaving the vessel at uncontrolled speed by its own weight. During the laying of the pipe 43, the latter will nestle onto the seabed by the fact that during the laying the drilling vessel is moving at a certain speed relative to the seabed. The drilling mast 1 can be used to ensure that even the last end of the pipe 43 is placed on the seabed in a controlled manner. A drilling string 50 is connected to the end of the pipe 43 which is only just situated on the drilling vessel, for example by welding said string to the pipe 43. By gradually lowering the drilling string 50 to the seabed by means of the drilling mast, the end of the pipe 43 will also reach the seabed at controlled speed. FIG. 4 shows the instance where a rigid pipe 43 rolled onto a reel is being laid on the seabed. With the same gear, it is possible to lay a flexible line or "flexible". In that case the use of straighteners is not necessary. It is also possible in this way to lay pipes which are not unreeled from a reel, but are welded to each other element by element. This laying method is necessary, for example, in the case of pipes which have to tolerate fatigue stress during use and which must not undergo plastic deformation during the laying. FIG. 4 also shows the cylinders 14 which make it possible to vary the vertical position of the drilling mast 1 and the auxiliary mast 2 relative to the deck of the drilling vessel. It is consequently possible to vary the position of the masts relative to the seabed during the laying of pipes.

Figure 5A:
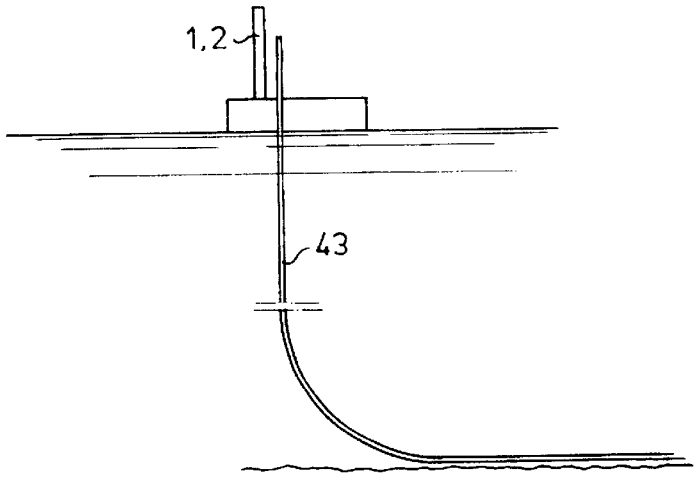
FIGS. 5*a*, 5*b* and 5*c* show the laying of lines with the aid of the drilling vessel.
Figure 5B:
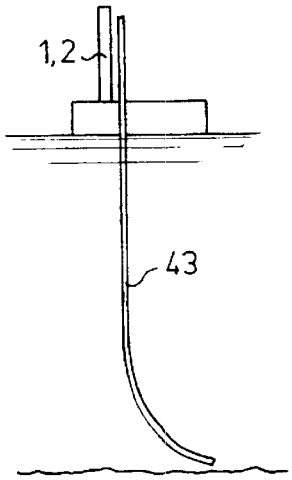
Figure 5C:
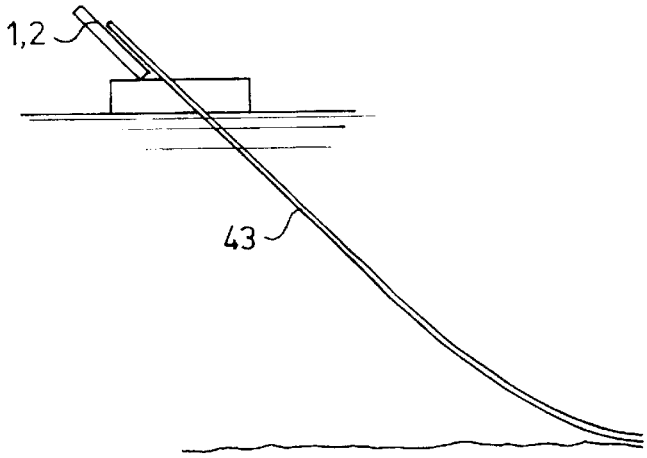

FIGS. 5*a*, 5*b* and 5*c* illustrate the function of rotation of the masts 1, 2. During the laying of rigid pipes at great depth, as shown in FIG. 5*a*, the pipe will automatically be sufficiently flexible to make the bend from the vertical laying direction to the horizontal seabed without breaking. However, if pipes are being laid at a lesser depth, the pipes will no longer be able to make this bend without undergoing plastic deformation. This instance is shown in FIG. 5*b*. By now rotating the position of the masts 1, 2 relative to the seabed, it is still possible to lay pipes at lesser depths without running the risk that they will break.

What is claimed is:

1. Drilling vessel with a drilling mast (1) for drilling in the earth's surface from said vessel by means of a drill string (20), comprising an auxiliary mast (2) next to the drilling mast (1), and a clamp carriage (8) which is movable in a guide (9) between a first position near the drilling mast (1) and a second position near the auxiliary mast (2), said clamp carriage (8) having at least two gripping clamps disposed at opposite sides of said clamp carriage (8), characterized in that the clamp carriage (8) comprises a top part (15), which is movable in the guide (9) and a clamp block (16) which is rotatably fixed on the top part (15) and is provided with said at least two gripping clamps, for clamping a first (10) and a second (20) drilling string, the positions whereof can be reversed by rotating the clamp block (16).

2. Drilling vessel according to claim 1, wherein the auxiliary mast (2) is connected to the drilling mast (1) by means of a brace (3).

3. Drilling vessel according to claim 1 in which said vessel comprises means for supplying drilling string elements to and discharging them from the drilling mast, wherein said means for supplying and discharging the drill string elements comprise a gripping arm for passing over the drilling string elements and said means for supplying and discharging the drill string elements can be moved between a first position in which drill string elements can be supplied to the drilling mast (1) and to a second position wherein the drill string elements can be supplied to the auxiliary mast (2).

4. Drilling vessel according to claim 1, wherein the drilling mast (1) and the auxiliary mast (2) are attached to the drilling vessel by means of hinges (11, 12).

5. Drilling vessel according to claim 4, wherein the drilling mast (1) and the auxiliary mast (2) achieve various angular positions by means of cylinders.

* * * * *